United States Patent [19]

Kataoka

[11] 3,968,622

[45] July 13, 1976

[54] ROLL PACKAGING APPARATUS

[76] Inventor: Hiroshi Kataoka, Ohmachi 1491, Toyooka-cho, Iyomishima, Ehime, Japan

[22] Filed: Aug. 19, 1974

[21] Appl. No.: 498,369

[52] U.S. Cl. ..... 53/59 R; 53/76; 53/214; 53/216; 53/226

[51] Int. Cl.[2] ..... B65B 57/14; B65B 11/32

[58] Field of Search ..... 53/137, 211, 214, 216, 53/75, 76, 226

[56] References Cited

UNITED STATES PATENTS

| | | | |
|---|---|---|---|
| 2,644,282 | 7/1953 | Irvine | 53/211 X |
| 3,296,772 | 1/1967 | Barker | 53/216 X |
| 3,342,014 | 9/1967 | Prager | 53/21 X |
| 3,380,223 | 4/1968 | Jasper et al. | 53/216 X |
| 3,466,848 | 9/1969 | Cuppini | 53/226 X |

*Primary Examiner*—Leon Gilden
*Attorney, Agent, or Firm*—Kurt Kelman

[57] ABSTRACT

The present invention relates to an apparatus for packaging various relatively thin and long rolls, which is suitable for packaging rolls having a center hole or recess in the opposite ends thereof. According to the present invention, it is possible to package the rolls with high efficiency and without the necessity of changing packaging paper rolls even when the length of the rolls to be packaged is varied. Firstly, a packaging paper is derived and cut from a packaging paper roll to a desired length and the cut paper sheet is put on a flat table. A roll to be packaged by this paper sheet is made to roll on the paper sheet in a direction normal to the paper sheet supply direction. When one edge of the packaging paper sheet is adhered to the roll to be packaged and the roll is advanced with the rotation thereof, the paper sheet wraps around the outer periphery of the roll tightly. Then, the wrapped rolls is rotated at a stationary position to take up opposite edge portions of the paper sheet protruding from the opposite ends of the roll and put them into the recessed portions of the roll to complete the packaging operation.

13 Claims, 11 Drawing Figures

ROLL PACKAGING APPARATUS

BACKGROUND OF THE INVENTION

The present invention resides in a packaging apparatus for various relatively thin and long rolls. It is known for such respective rolls that it is easy, in principle, to package the rolls because after an outer periphery of the roll is wrapped by the packaging paper it is sufficient to merely put the excess portions of the packaging paper edges extending from the opposite ends of the roll into a center shaft hole thereof. However, there are various problems in automating the packaging operations with high efficiency.

Firstly, a packaging appparatus responsive to various rolls of different sizes is required. The conventional packaging apparatus using packaging paper of a fixed size is clearly inadequate from this point of view. Further, in one of the conventional packaging techniques, in which a roll of packaging paper is prepared in an overhead position and a paper derived from the paper roll is cut after it wraps a roll put on a receiving roller, it is required to prepare paper rolls having different widths according to the sizes of the rolls to be wrapped. Further, in this method, it is difficult to tightly wrap relatively thin rolls and it requires a complex mechanism to put adhesive on and along the edges of the packaging paper sheet cut from the paper roll. Further, it is known that a mechanism for feeding rolls to be packaged to a wrapping position, a mechanism for treating the edges of the packaging paper and a mechanism for supplying the packaging paper, etc., affect the packaging efficiency considerably although the efficiency is mainly determined by a packaging paper wrapping mechanism.

The term "packaging paper sheet" used here means a sheet of any material usable for packaging purpose.

SUMMARY OF THE INVENTION

An object of the present invention is to provide an automatic packaging apparatus which uses a roll of packaging paper and is capable of automatically packaging various relatively thin and long rolls with high efficiency. Another object of the present invention is to provide an automatic packaging apparatus which is capable of packaging rolls of various sizes with a roll of packaging paper having a common width. A further object of the present invention is to provide a roll packaging apparatus having an automatic control device which detects variations of roll size and automatically responds thereto to regular various factors of the apparatus.

A still further object of the present invention is to provide an automatic packaging apparatus capable of packaging rolls having delicate surfaces.

Another object of the present invention is to provide a roll packaging apparatus in which, by arranging the packaging paper supplying direction onto a packaging table normal to the roll supplying direction, the respective constituent mechanisms are reasonably arranged so that it is readily responsive to the variation of roll size and the deposition of adhesive onto the edges of the packaging paper and a provision of seam perforations in the paper are facilitated.

A further object of the present invention is to provide a pasting device for the packaging paper in movement. Another object of the present invention is to provide a mechanism for treating excess portions of the packaging paper protruding from the opposite ends of the wrapped roll. A further object of the present invention is to provide a labelling mechanism for labelling the rolls during the packaging operation. A still further object of the present invention is to provide a position correcting mechanism for the rolls to be packaged and the packaging paper. Another object of the present invention is to provide a mechanism for providing seam perforations to relatively thick packaging paper to facilitate the folding thereof and to facilitate removal of the packaging paper from the final packaged roll when it is desired to be used.

In order to achieve these objects, the roll packaging apparatus according to the present invention is constituted with, mainly, a generally rectangular packaging table on which the packaging operation is performed, a roll supplying device disposed behind the packaging table for supplying rolls to be packaged to the packaging table, a packaging paper cutting and supplying device disposed at one side of the packaging table, a mechanism for putting the paper sheet supplied by the paper cutting and supplying device at a predetermined position on the packaging table and a roll driving device for advancing the rolls with rotation thereof from the rear to the front position in the packaging table to wrap them with the paper disposed on the packaging table.

In general, a paper edge treating device for treating the excess portions of the paper sheet protruding from the opposite ends of the wrapped roll is provided adjacent to the packaging table to put the excess portions into the center hole of the roll. Preferably, a storage space for storing packaged rolls is provided in the downstream thereof.

As other options, there are a specially designed pasting device, a labelling device and a perforation device etc..

SUMMARIZED EXPLANATION OF THE DRAWINGS

Figure 1:
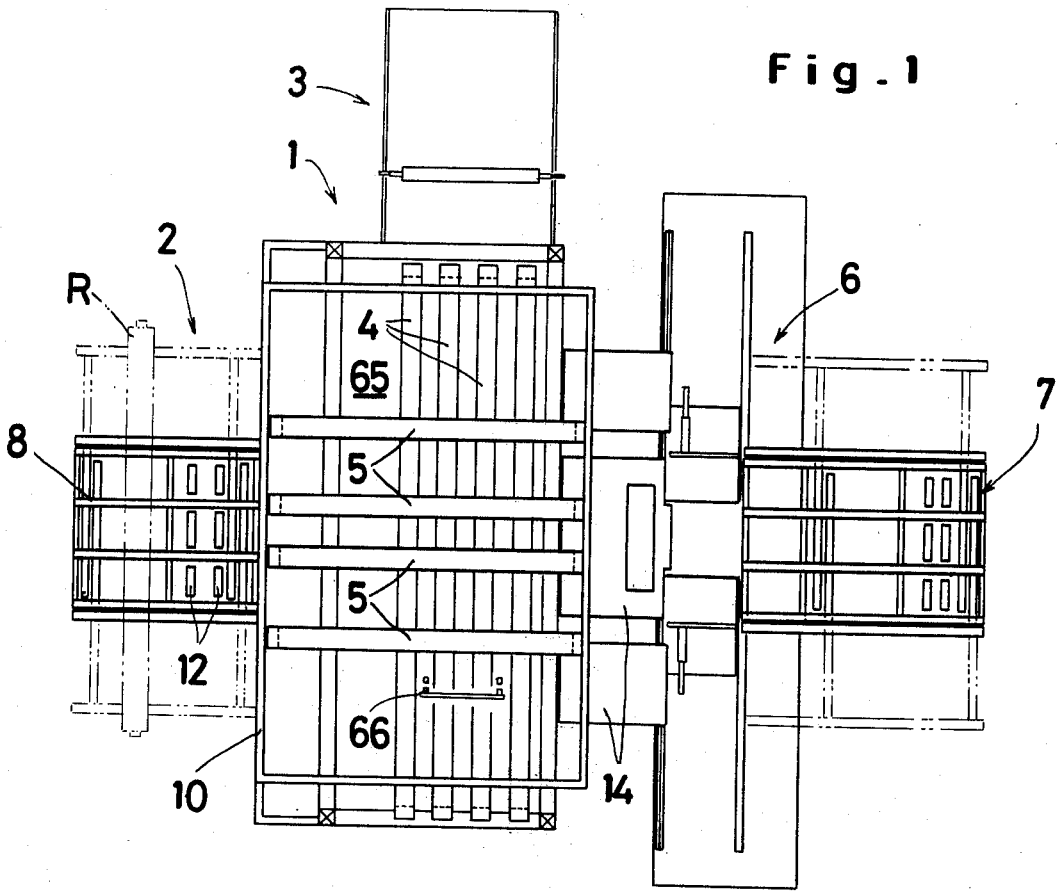
FIG. 1 is a plane view of an embodiment of a roll packaging apparatus according to the present invention.
Figure 2:
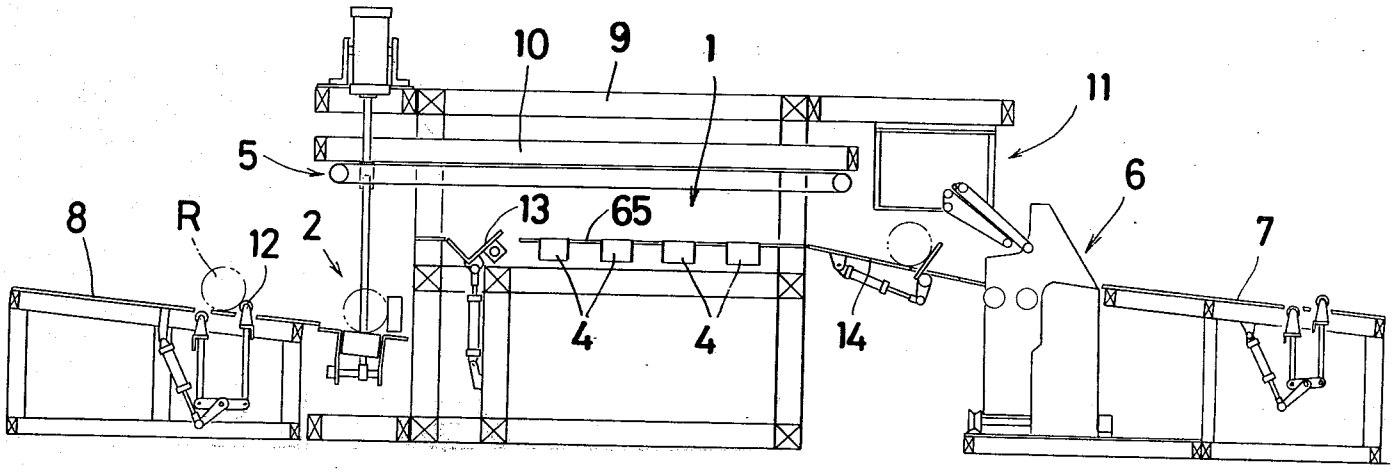
FIG. 2 is a cross-section front view of the apparatus in FIG. 1.

DETAILED EXPLANATION OF PREFERRED EMBODIMENTS:

FIG. 1 is a plane view of an embodiment of the present invention and FIG. 2 is a cross-sectional front view of the same. Main portions of the present apparatus are a generally rectangular packaging table 1 on which the packaging operation is performed, a roll supplying device 2 provided in one side of the table 1, a packaging paper cutting and supplying device 3 provided behind the table 1 for cutting a packaging paper sheet from a roll of the packaging paper and supplying it to the table, a transportation mechanism 4 for transporting the paper sheet onto a desired position on the table 1 and a roll driving device 5 for putting a roll R on the packaging paper disposed on the table 1 and advancing it with rotation thereof from one side (left side in FIG. 1) to the opposite side (right side in FIG. 1) of the table 1 to wrap the sheet around the roll R. Further, an excess paper portion treating device 6 is provided on the right side of the packaging table 1 and an inclined table 7 is provided in that side for discharging the packaged rolls into a product storage space. In the opposite side, another inclined table 8 is provided for feeding rolls R into the packaging table 1. Stems provided at the four corners of the rectangular packaging table 1 extend upwardly and support an upper frame 9. A movable horizontal frame 10 provided between the upper frame 9 and the packaging table 1 is vertically movable therebetween and, together with a belt and a driving device therefor, constitutes the roll driving device 5 which will be described hereinafter.

The packaging table 1 includes a packaging surface or an upper plane which is comprised of a plurality of parallel surface segments between which conveyer belts run. This arrangement constitutes the packaging paper transportation mechanism 4.

As to the roll supplying device 2 comprising a hydraulic pressure cylinder mounted on the left end of the upper frame 9 in FIG. 2 and a roll receiving device vertically driven thereby and the labelling device 11 fixedly mounted on the lower surface of the frame 9 at the right end position thereof, as well as the aformentioned other main components, they will be described respectively in detail.

The roll R supplied to the inclined table 8 contacts with and is held by a stopper 12, and, when it is advanced to the roll supply device 2, the center thereof is made coincident to a center line of the packaging apparatus. The roll R is then elevated by the supply device 2 and, at the highest position, shifted to the left end of the table 1. Immediately after this shift, the roll R rolls into a triangular groove 13 at which the direction of the roll is aligned to the orientation of the packaging table 1.

After the roll R reaches the groove 13 it is driven by the belt of the roll driving device 5 rightwardly.

On the other hand, a packaging paper sheet (not shown) of a desired size supplied by the cutting and supplying device 3 from the paper roll has been put in a desired position on the packaging table 1 by a belt of the transportation device 4. If the opposite ends of the packaging paper sheet have been provided with adhesive, the left edge thereof will firstly adhere to the roll R during the rolling advancement of the roll from the left end of the table 1 to the center position thereof. Then, with a further rolling advance of the roll R, the packaging paper sheet will wrap the roll until the roll R is completely wrapped and finally the right edge of the paper sheet will adhere to the wrapped roll R to assure the package. The roll R wrapped by the packaging paper sheet in this manner continues its rolling advance from the packaging table 1 through an intermediate plate 14 to the excess portion treating device 6. In the excess portion treating device 6, the excess paper sheet portions protruding from the opposite ends of the wrapped roll R are folded and gathered and the gathered portions are inserted into the center hole of the roll R to complete the package. Simultaneously with this operation, the labelling device 11 labels the outer periphery of the packaged roll. The completely packaged roll is then conveyed through the inclined table 7 to the storage position. The devices mentioned hereinbefore will be described in detail respectively hereinafter.

The purpose of the roll supply device 2 is to supply various rolls R onto the packaging table 1 continuously and individually.

Figure 3:
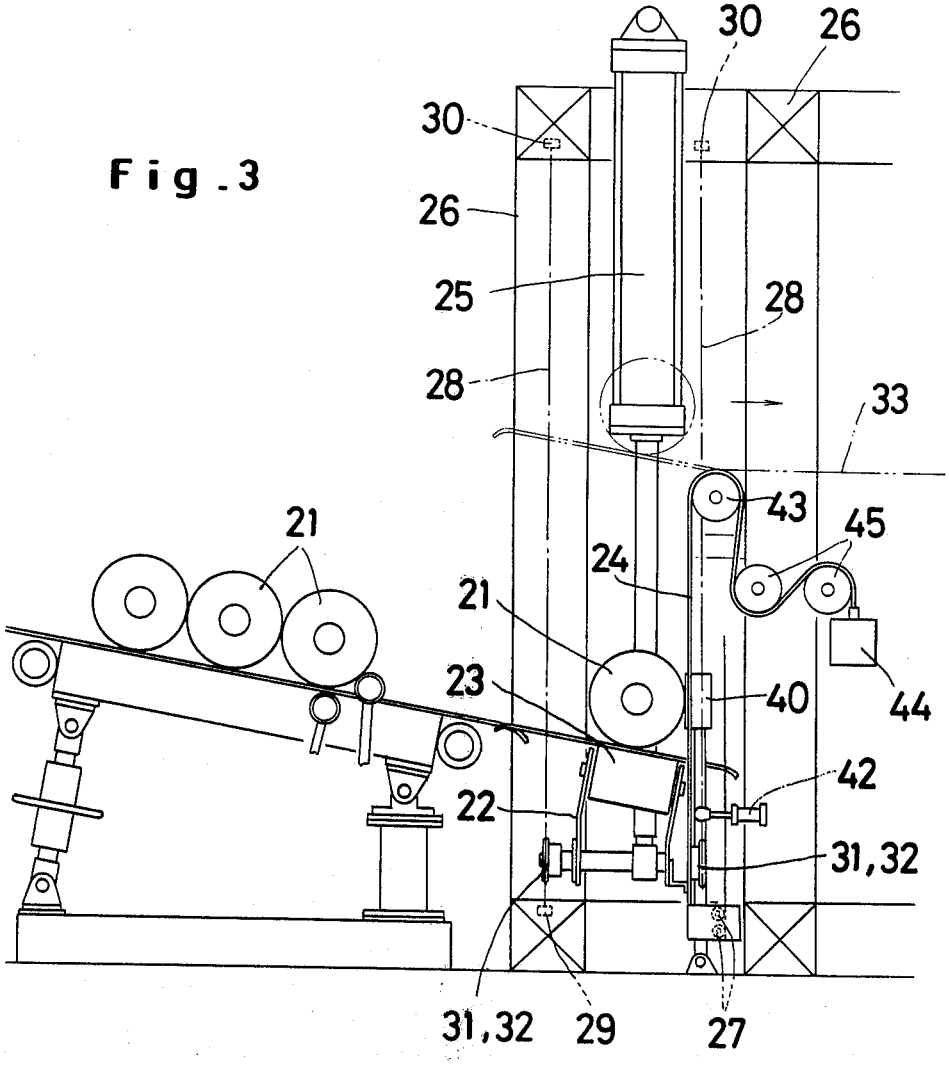
FIG. 3 is a front view of an embodiment of a roll supplying device according to the present invention.
Figure 4:
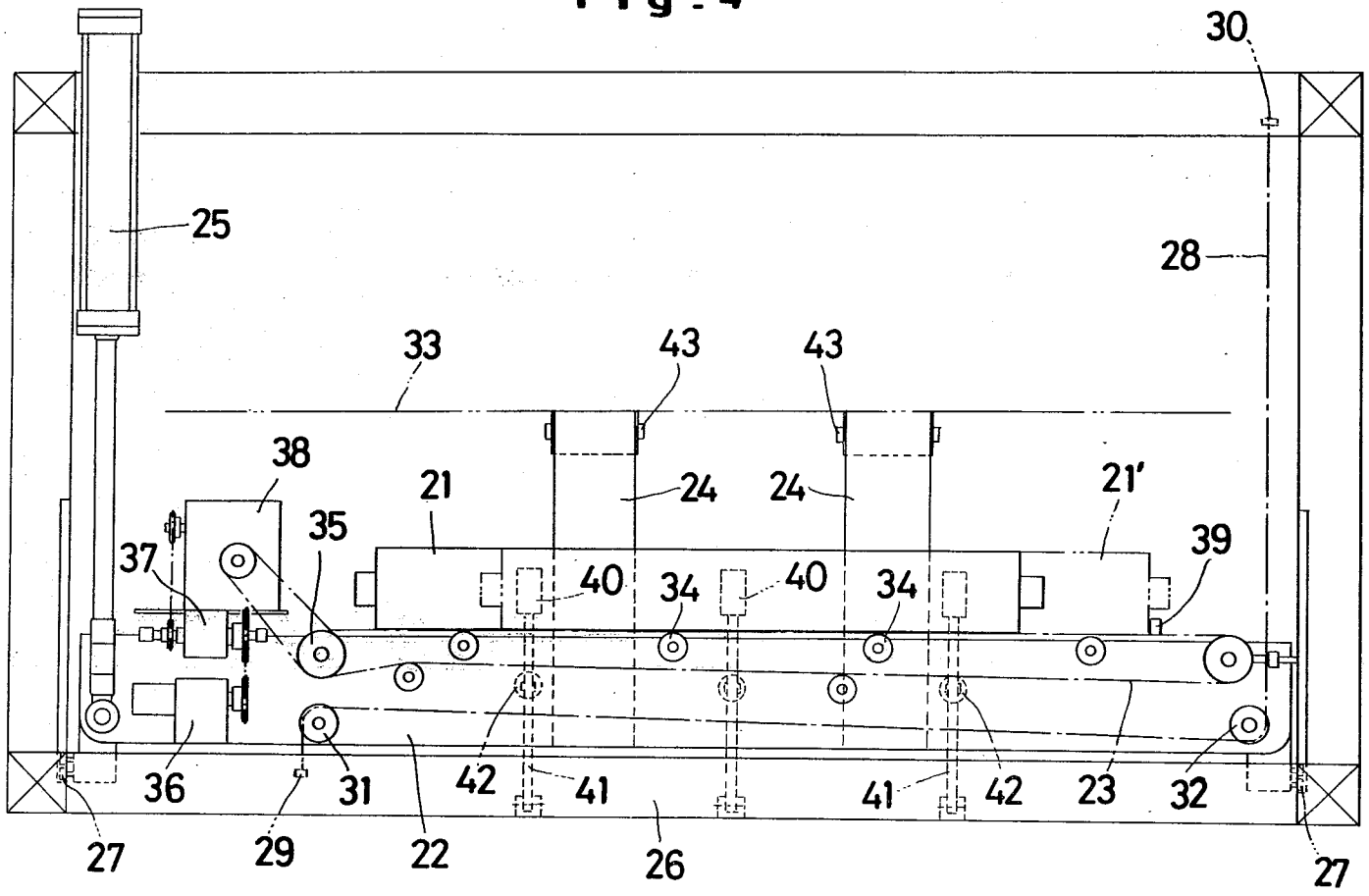
FIG. 4 is a side view of the device in FIG. 3.

FIG. 3 is a front view of an embodiment of this device and FIG. 4 is a side view of the same, in which the roll R to be packaged is a roll 21 of plastic film. This device is composed mainly of a load receiving frame 22 supported horizontally and movable vertically, a floor 23 provided on the load receiving frame 22 and capable of axially shifting the roll and, when inclined, of permitting the roll 21 positioned on the frame 22 to roll out by gravity and a means such as a suspending belt 24 in this embodiment, provided in the output side of the load receiving frame 22 for preventing the roll 21 from rolling out until it reaches the upper discharge position.

The load receiving frame 22 is, in this embodiment, driven vertically by a single oil pressure cylinder 25. The cylinder 25 is supported by a base frame 26 and the load receiving frame 22 is moved vertically along the base frame 26 via guide rollers 27. A pair of parallel chains 28 assure the vertical movement of the load receiving frame 22. The upper and lower ends of the chains 28 are fixed to an upper portion 30 and a lower portion 29 of the base frame 26 respectively. The intermediate portions of the chains 28 mesh with chain wheels 31 and 32 provided at the opposite ends of a shaft penetrating through the lower left and right end portions of the load receiving frame 22. When one end of the load receiving frame 22 is lifted by the cylinder 25, the chain wheel 31 associated with that end is moved upwardly by a certain distance and the chains 28 are pulled rightwardly in FIG. 4 by the same distance. This means that the length of the chain portion extending upwardly from the chain wheel 32 is shortened by a length corresponding to that distance since the length of the chains between the chain wheels 31 and 32 are constant and, therefore, the levels of the chain wheels 31 and 32 are always maintained at the same during the vertical movement thereof. Other driving systems than the above for the load receiving frame 22 can be used arbitrarily.

The floor 23 for receiving the roll 21 is mounted on the load receiving frame 22 as mentioned previously. The floor 23 has a unique construction. That is, it has an inclination to provide functions that, when the floor 23 is raised and reaches a predetermined vertical level 33 at which the roll 21 put on the floor should be self-transported out, the roll 21 can roll away by gravity and that it can regulate previously the axial position of the roll 21 thereon so that the roll 21 can correctly be self-transported to the predetermined position at the desired level. In this embodiment, the floor 23 is in the shape of a belt conveyer provided on the upper plane of the load receiving frame 22. The number of the rollers 34 supporting the conveyer is arbitrary and the shafts of these rollers are inclined to provide the inclination of the floor.

An electric motor 36 for driving a driving wheel 35 of the conveyer belt, a magnetic clutch 37 for control therefor and a worm reduction gear mechanism 38 are also mounted on the load receiving frame 22. Therefore, it may also be possible to regulate the position of the roll on the floor during the elevation of the load receiving frame 22.

In this embodiment, in supplying the roll onto the floor 23, the roll 21 is initially positioned on the relatively left side on the floor 23. And then the conveyer type floor 23 is driven until one end of the roll 21 contacts with a stopper 39 mounted on the load receiving frame 22. In FIG. 4, a roll 21' shown by a dotted line shows the initially regulated position and, by being so, the roll 21 will ultimately be put in a correct discharge position, that is, in this embodiment, in a center position of the packaging paper sheet previously flattened on an upper plane 33 of the packaging table. Since the roll is at rest on the conveyer belt, it is not necessary to take into consideration the weight thereof and there is no problem of scratching of the roll surface.

In this embodiment, when rolls of different lengths are to be packaged, an operator of this apparatus will regulate a position regulation mechanism to regulate the position of the stopper 39. Since such a position regulation mechanism is well known in the mechanical field, it is omitted from the drawings and so no detailed explanation thereof is provided.

If means for previously measuring the length of the roll to be packaged is added to such position regulating mechanism and a measured length is supplied to the position regulating mechanism to shift the stopper 39 by a required distance, the position regulation of the stopper 39 may be automated.

The slippage of the roll 21 with respect to the floor 23 is substantially avoided in the above mentioned manner. However, cases can be considered such as when the surface of the roll is weak to such an extent that it may be scratched even by the slippage between it and the means for supporting the roll 21 preventing it from dropping away from the floor, that is, in this embodiment, the suspending belts 24. In order to overcome this problem, freely rotatable roller 40 are provided slightly in front of the suspending belts 24 so that, when the roll 21 is fed thereto, it is firstly received softly by the rollers 40 and so that, even when the roll 21 is moved on the floor 23 for the purpose of the position regulation, the slippage between the roll 21 and the suspending belts 24 is prevented. The contact rollers 40 are, in this case, mounted on swing arms 41 standing from a shaft provided in the base table 6 and, when the load receiving frame 22 is lifted, reclined rearwardly by means of an air pressure cylinder 42 to move away from the roll 21.

The suspending belts 24 constitute a means for preventing the roll 21 from escaping from the floor until it is lifted and reaches the transport position. The lower ends of the belts 24 are secured to the load receiving frame 22. These belts 24 pass through rollers 43 and 45 and the other ends thereof are weighted by weights 44. The level of the first roller 43 is, of course, selected so that when the floor 23 is lifted to a desired level, that is, a level shown by a dotted line 33 in FIG. 3, the roll 21 smoothly rolls out past the roller 43. The purpose of the secondary rollers 45 are to define the horizontal position of the weights 44 and, therefore, may be omitted if necessary. The values of the weights 44 must be enough to provide sufficent tension to the belts 24 to prevent the roll 21 from escaping from the floor. These suspending belts 24 function to prevent the roll 21 from escaping during the upward movement of the load receiving frame 22 as well as to prevent slippages which would ocur between the roll and the base frame etc., and these functions are naturally cease when the roll reaches the desired level. It should be appreciated that, although this mechanism is extremely effective, the present invention is not limited by this mechanism and any other mechanism may also be employed. For example, it may be possible to provide a means similar to the rollers 40 on the load receiving frame 22, which, when the roll 21 reaches at the desired level, sinks or is lowered to release the blocking thereof and to permit the rolling escape of the roll.

In FIG. 3, a mechanism for supplying a plurality of rolls 21 onto the floor 23 continuously and individually is shown. However, such mechanism does not limit the present invention. For example, it may be possible to provide a conveyor along the length of the floor 23 to feed the rolls continuously. Further, the position regulation of the roll on the floor 23 may be performed by constructions other than the conveyor type construction shown. There may be many mechanisms for lifting the floor 23 on the load receiving frame 22.

The above described roll supply device provides many advantages such as that since an inclined floor is employed, the roll can roll out by gravity and, therefore, a roll driving mechanism becomes unnecessary and also that since the position regulation of the roll is performed on the load receiving frame by shifting it laterally and since the elevation of the roll is performed by the elevation of the floor and the means for preventing the roll from escaping, there is no problem of scratching of the roll surface due to slippages between the roll and other stationary member, etc. According to the present invention the position regulation of the roll is performed by the mechanism shown which is readily automated by an electrical control and is suitable for performing a full-automatic sequence control of the whole operation including the reception of the rolls, the position regulation thereof and the shifting of the roll to the packaging table.

The function of the packaging paper cutting and supplying device 3 is to derive a packaging paper sheet S from a roll of the packaging paper, to cut it to a length suitable to wrap the roll to be packaged and to feed the cut sheet S to the packaging table 1.

Figure 5:
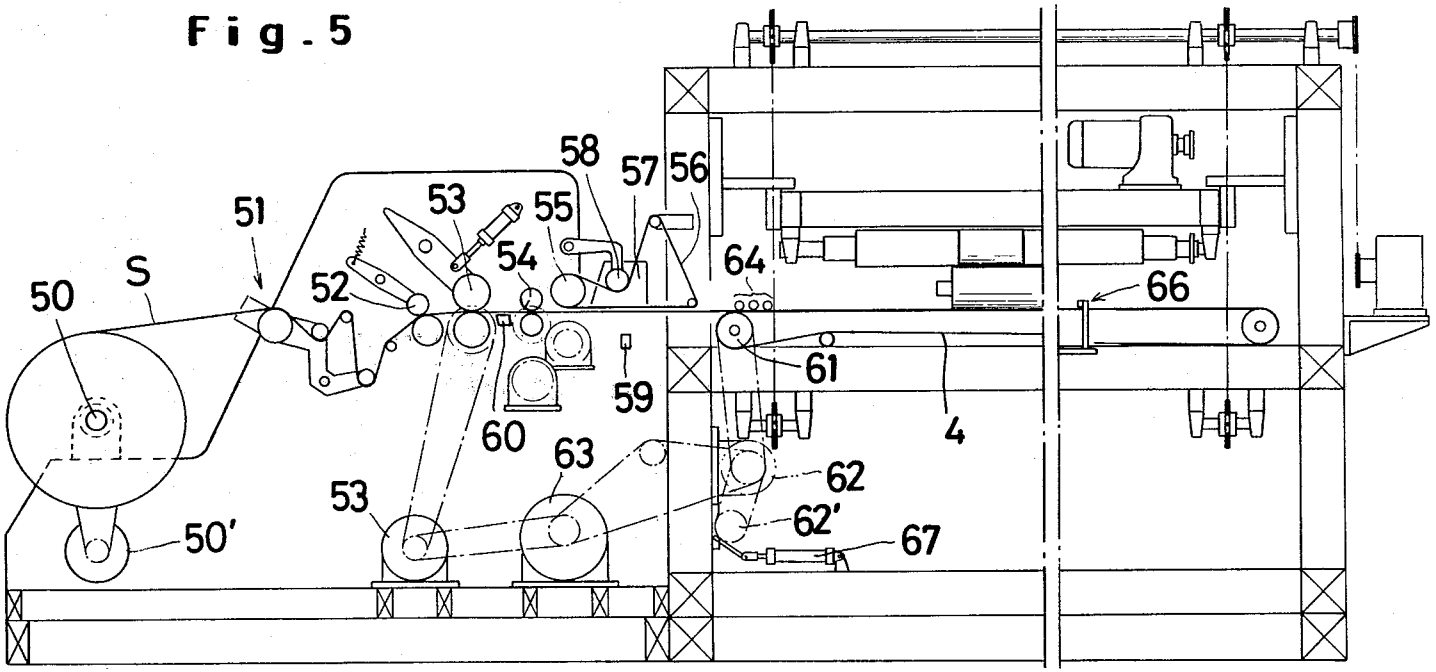
FIG. 5 is a front view of an embodiment of a packaging paper cutting and supplying device according to the present invention.

In this device shown in FIG. 5, reference numerals 50, 51 and 51' show a support shaft for the packaging paper roll, a dancer roller portion and a dancer mechanism for the shaft, respectively. The shift amount of the dancer roller is fed back to the damper mechanism 50' to automatically control thereby the tensions to be given to the packaging paper to derive the paper sheet from the paper roll. 53 is a pinch roller unit for feeding the sheet and is driven by a motor 63 through a clutch-brake unit 53'. Adjacent to the lower roller of the pinch roller unit 53, an detector 60 is provided for measuring the length of the sheet and signalling when a predetermined length is detected to cause a cutter 54 to cut the sheet S. In this manner, a packaging paper sheet of a suitable length for the roll to be packaged thereby is fed. The length which the detector 60 signals is set by the operator who knows the size of the roll or is automatically, regulated by an output signal of a length and diameter detector.

When the axial length of the roll varies, the length of the paper sheet must be varied accordingly. In addition to this, the diameter of the roll also affects the determination of the length of the paper sheet because the size of the excess portions of the sheet which appear after the wrapping of the roll is over and which should be folded into the center hole of the roll also varies accordingly. Since the roll axial length and the roll diameter detector functions to merely determine the cutting size of the paper sheet, accuracy thereof is not an essential matter and any conventional detector may be used, and therefore the details thereof are omitted in this specification. For example, it may be possible to measure the roll by mechanically or optically compassing the opposite ends and the opposite sides of the roll and read out the values by converting them to electric signals. It may be preferable to provide an alarm for when the diameter of the roll is too large with respect to the width of the paper sheet. In such a case, it may be sufficent to prepare two rolls of the paper sheet. That is, it may be possible to cover a roll having a diameter of about twice the width of the single paper sheet by feeding two parallel paper sheets with the adjacent edges thereof overlapped. In this embodiment it is easy to overlappingly join the edges of the paper sheets.

A perforating knife 52 in FIG. 5 is provided for providing longitudinal seam perforations to the sheet S. The cutter 54 momentarily cuts the sheet between an upper and a lower cutting edge thereof. 55 is a driving pulley for a pasting belt 56.

In this embodiment, the packaging paper is not only cut to a desired size but is also provided with perforations and paste and fed to the packaging table 1.

As a characterized feature of the present invention, both cut edges of the packaging paper sheet extend from the opposite ends of the roll, so that it becomes easy to change the length of the paper sheet according to the variation in the axial length of the roll and breaking problems which possibly occur in feeding the excess paper portions into the center hole of the roll are substantially reduced because the folding is made in the direction of the paper fibers which usually is substantially in alignment with the longitudinal direction of the paper sheet. Further, since, fortunately, the wrapping start end and the wrapping termination end of the sheet correspond to the opposite ends thereof, the provisions of paste to these ends and of seam perforations in the longitudinal direction of the sheet become easy. The purpose of the pasting is, of course, to adhere the paper sheet to the roll and the purpose of the seam perforations is to facilitate the removal of the packaging paper sheet along the seam when the packaged roll is to be used. According to the present packaging apparatus, since paper sheet intimately contacts with the roll surface, the seam line perforations function effectively. Another merit due to the provision of the seam line perforations is to provide a flexibility of bending or folding a relatively thick paper sheet around the roll and of folding the excess portion thereof into the center hole of the roll. In the case where a relatively small diameter roll is to be wrapped by such a relatively thick paper sheet, the seam line perforations are very effective. It would be sufficient to provide such seam lines in, particularly, the wrapping paper start portion and the wrapping end portion of the sheet which are usually difficult to fold. If the paper sheet wraps the roll twice, the problem of permeation of water through the seams to the roll will be minimized.

The pasting device has a unique construction in that an endless pasting belt 56 composed of a pair of parallel endless strings of rubber runs on and in parallel with the sheet S through a paste container 57. A pressure roller 58 forces the belt 56 to pass through the paste liquid contained in the paste container 57. The sheet S is urged upwardly by an air nozzle 59 disposed under the sheet so that the upper surface of the sheet S contacts with the pasting belt 56. Since the paste is provided on the upper surface of the sheet S during the operation of the air nozzle 59, the automation of the pasting may be easily realized and, further an intermittent pasting is also possible by controlling the blower. The latter is preferred in cases where too large an amount of paste is required for continuous pasting. Of course, it is possible to provide paste to either or both of the edges of the sheet S.

Since the pasting belt 56 runs at the same speed as or at a higher speed than the speed of the sheet S, it enhances the advance of the sheet S while providing the paste thereto. Although a single rubber belt may constitute the belt 56, it is preferable to constitute it with such parallel strings, because, in the latter case, the adhesion of the paste to the paper sheet is improved. Such a belt of rubber has a greater durability than that of the conventional brushes and it is easily possible to change the position thereof and or change the number of the pasting belts.

In the transportion mechanism 4 for laying the packaging paper sheet on the packaging table 1, the packaging paper sheet S cut from the paper roll is fed in a flattened state onto the packaging table 1. The purpose of the mechanism 4 is to receive the incoming flat sheet and position the same in a desired position on the packaging table 1. If a single flat plate is used as a surface plate of the packaging table, a plurality of parallel grooves are provided on the flat plate to divide the surface. Otherwise the surface plate may be composed of a plurality of parallel plates extending in the direction along which the paper sheet is to be fed, with the space between the adjacent ones being sufficient to run a belt, such as a conveyor belt, at a horizontal level slightly higher than that of the plane of the surface plate. The conveyor belts which are labelled 4 in FIGS. 1, 2 and 5 as the transportation mechanism, conveys the packaging paper sheet.

The belt 4 is driven by a motor decelerator 63 via a pully 61 and a clutch 62 and is supported by means of a plate 65 to prevent it from slacking.

In order to assure that, when the front edge of the packaging paper sheet reaches the rear end of the packaging table 1, it rides on the belts 4, a group of three balls 64 are provided on each of the belts 4 around the paper receiving end of the table 1. The balls are rotatably supported by brackets and rotated in stationary positions. These balls 64 may be replaced by rollers. The weights of these balls press the sheet S onto the belts 4 to assure the belt holding thereof. Since, in the case where the sheet S is very light, the feeding thereof can not be assured by merely putting it on the conveyor belts 4, it is preferred to provide such pressing means as the balls 64 throughout an area within which the sheet is to be held. However, such is usually not required.

In this manner, the sheet S is provided with the seam line perforations and the paste, and transported on the packaging table by the conveyor belts 4. In order to stop the sheet S at a desired position, a photo-electric detector 66 is provided on the packaging table. The detector 66 provides an output signal when the front edge of the sheet S blocks a light directed to the detector 66. The signal is used to disengage the clutch 62 to stop the driving of the conveyor belts 4 and simultaneously engage a clutch 62' to actuate a fluid pressure cylinder 67 to reverse the conveyor belts 4. That is, the movement of the paper sheet S is reversed immediately after the front edge thereof passes the photo-electric detector disposed at the predetermined stop position thereof. The forward movement of the paper sheet toward the stop point is at a relatively high speed and after the front edge thereof passes through the point it is driven rearwardly at a relatively low speed. As a result, by stopping the rearward driving of the belts immediately after the blocking of the light due to the sheet is terminated, the sheet is stopped at the desired position. Although, in this embodiment, a single common photo-electric detector is used for both the reverse driving and the stopping of the driving, it may be possible to use two photo-electric detectors to control the reverse driving and the stopping, respectively. Since the distance of the reverse movement is very short, it is controlled by a fluid pressure cylinder, in this embodiment. However, any other means may be employed for the same purpose. Also, in this embodiment, the photo-electric detector is disposed such that the light beam to be directed thereto is at an angle thereto so that the detector does not interfere with the wrapping of the roll with the paper sheet which has been stationary. The position of the photo-electric detector 66 is changed according to the length of the packaging sheet. The change of the position may be made manually by the operator. However, in order to fully automate this procedure, it is preferred to drive a regulation mechanism of the detector by command signals obtainable from the measuring means for the length and diameter of the roll to be packaged. Since according to the present invention, the packaging paper sheet can be stopped exactly at the desired position, the loss of the sheet is minimized and the final packages are always uniform.

The function of the mechanism of the upper portion of the packaging table 1 is as follows.

Figure 6:
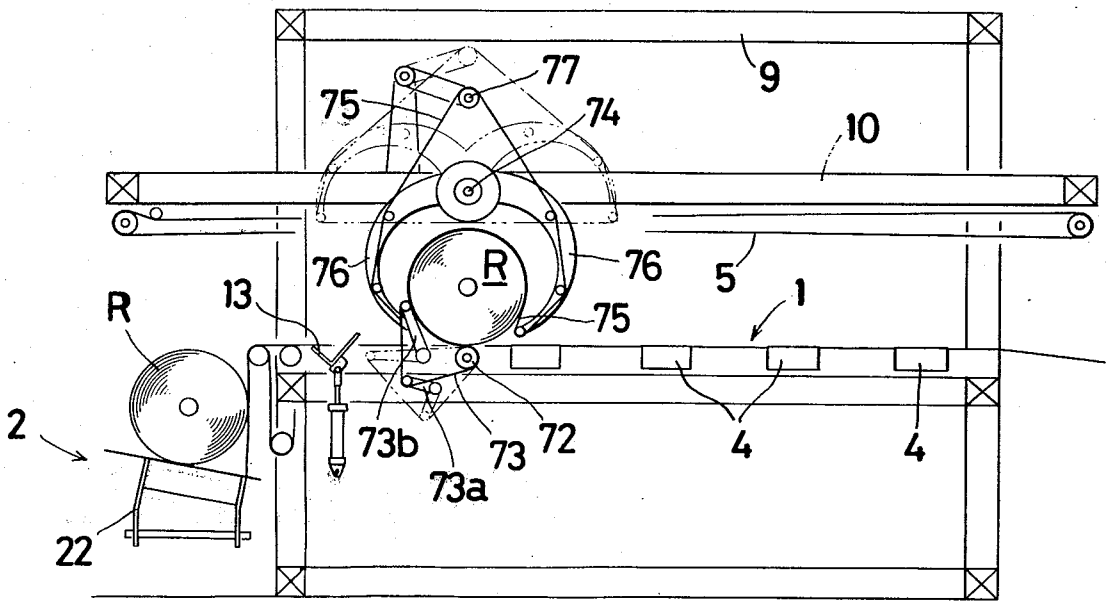
FIG. 6 is a front view of an upper portion of the packaging table according to the present invention.
Figure 7:
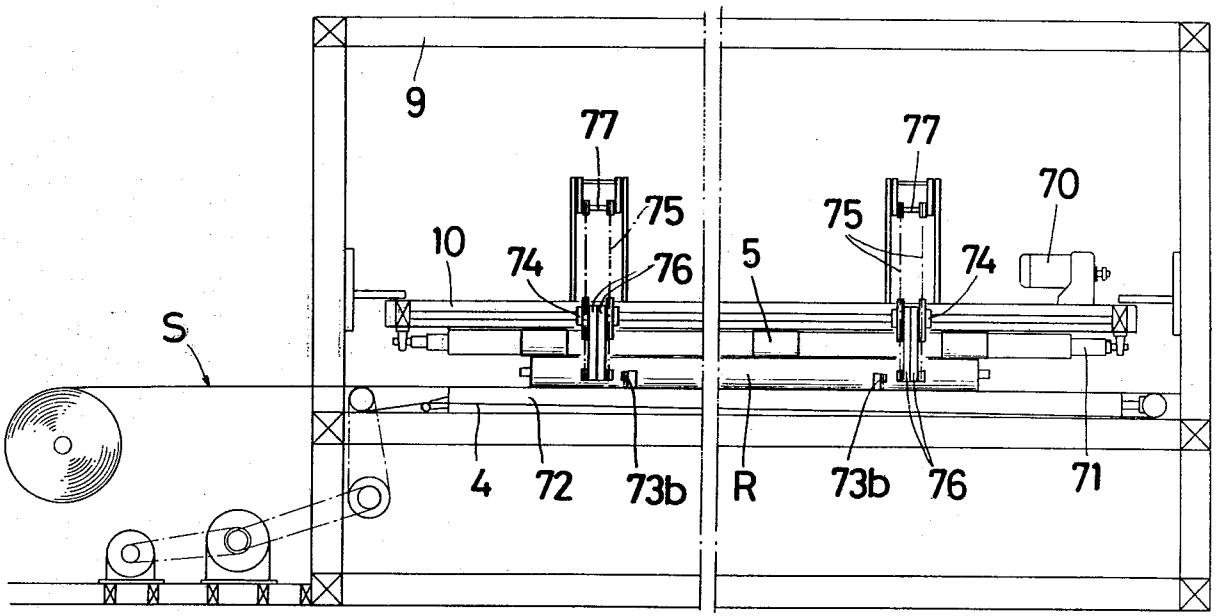
FIG. 7 is a side view of the packaging table in FIG. 6.
Figure 8:
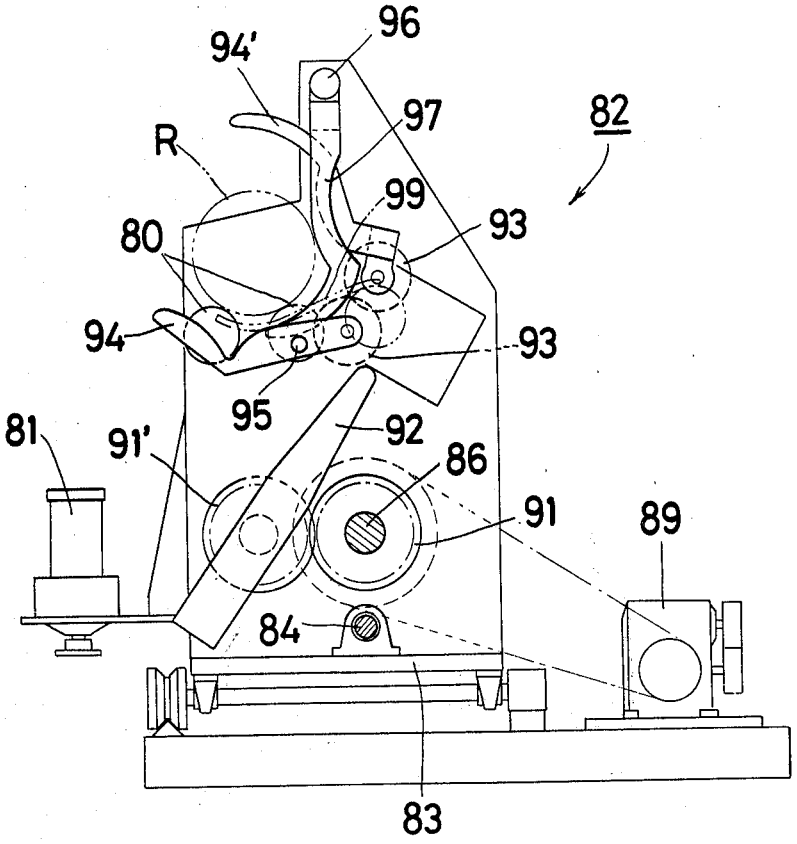
FIG. 8 is a front view of an embodiment of an excess portion treating device according to the present invention.

As mentioned previously, the roll R to be packaged is fed to the packaging table in a lateral direction to the packaging sheet S flattened on the table 1 and put thereon, and thereafter received in the triangular groove 13 as shown in FIG. 2. The groove 13 serves to align the roll R to a correct direction. The triangular groove 13 is lifted and tilted by a fluid pressure cylinder, so that the roll R rolls rightwardly. The roll R is further advanced on the table 1 by a combination of a horizontal frame 10 provided movably vertically above the packaging table 1, an endless belt 5 stretched along the lower surface of the horizontal frame 10 movable in the feeding direction of the roll R, a driving means, i.e., a motor 70 for driving the endless belt and a common driving shaft 71, etc., as shown in FIG. 7. FIGS. 6 and 7 are a front view and a side view of the combined mechanism, respectively, in which the former shows the roll of the maximum size and the latter shows the roll R of minimum size. The horizontal frame 10 is vertically regulated depending upon the size of the roll R to be packaged and the roll R rolls and is advanced by the belt 5 provided beneath the frame 10. Where the opposite edges of the packaging paper sheet are pasted, the first edge adheres firstly to the roll R when it reaches that edge and the sheet wraps the roll during its rolling advance. Then, when the roll reaches the other, i.e., the second edge of the sheet, it adheres to the sheet on the roll to complete a wrapping. Therefore, the horizontal frame 10 and the belt 5 are essential to wrap the roll with the paper sheet.

In order to avoid the pasting on the roll surface, devices described below are provided. That is, a packaging paper sheet, only the second edge of which is pasted, is put on the table 1. A receiving roller 72 is provided under the surface of the table 1 and at a position directly below the position where the roll R rides on the first edge which is not pasted, so that the roll R is supported stationarily with respect to the sheet edge by the roller 72 to assure the intimate contact of the paper sheet with the roll surface. Where a single receiving roller 72 is employed as shown in FIG. 6, the roll R may not be stably supported. For this reason, arms **73*a* and 73*b* are provided. A belt 73 is stretched triangularly through small pulleys provided on the tops of the arms and a pulley coaxial with the roller 72. When the roller 72 is rotated under this condition, the roll R is also rotated accordingly and the first edge of the paper sheet which is pinched by the roll and the roller is moved clockwisely with the rotation of the roll. That is, the paper sheet put on the packaging table 1** wraps around the roll.

On the other hand, directly above the receiving roller 72, there is provided a plurality of open-close type belt supporting arms 76 which have a shaft 74 supported by the horizontal frame 10 and grasp the roll R due to an action of a circulating belt 75. The arms 76 are relatively pivotable between an upper rest position and a lower position at which the arms 76 and the belt 75 hold the roll R. The belt 75 is stretched circularly around an upper movable pulley 77, around three small pulleys on one of the arms, around a portion of the outer surface of the roll R and around three small pulleys on the other arm back to the pulley 77.

Therefore, the first edge of the packaging paper sheet passes around the surface of the roll with the rotation thereof and is finally put into the original position between the lowermost surface of the roll R and the roller 72 and pinched thereat. The subsequent works are the same as those previously mentioned, that is, the roll R is rotatingly advanced by the belts 5 taking up the paper sheet portion which is still on the packaging table 1 around the roll R. The upper and the lower belts and the associated arms do not, of course, interfere with the advancement of the roll because they are returned to their original rest positions at that time.

Although the height of the horizontal frame 10 must be regulated dependent on the diameter of the roll R, it may be automatically and easily regulated by using the signal from the measuring means for measuring the diameter of the roll R.

In the excess paper sheet portion treating device 6 the roll R wrapped on the packaging table 1 by the packaging paper sheet passes the intermediate plate 14 and is received by short receiving rollers 80 of the excess portion treating device 6. One of the rollers 80 is driven to rotate and both of the rollers 80 are movable vertically to regulate the center axis of the roll such that, when the diameter of the roll is changed, the center line is automatically aligned to the center of the excess portion treating device 6.

Figure 9:
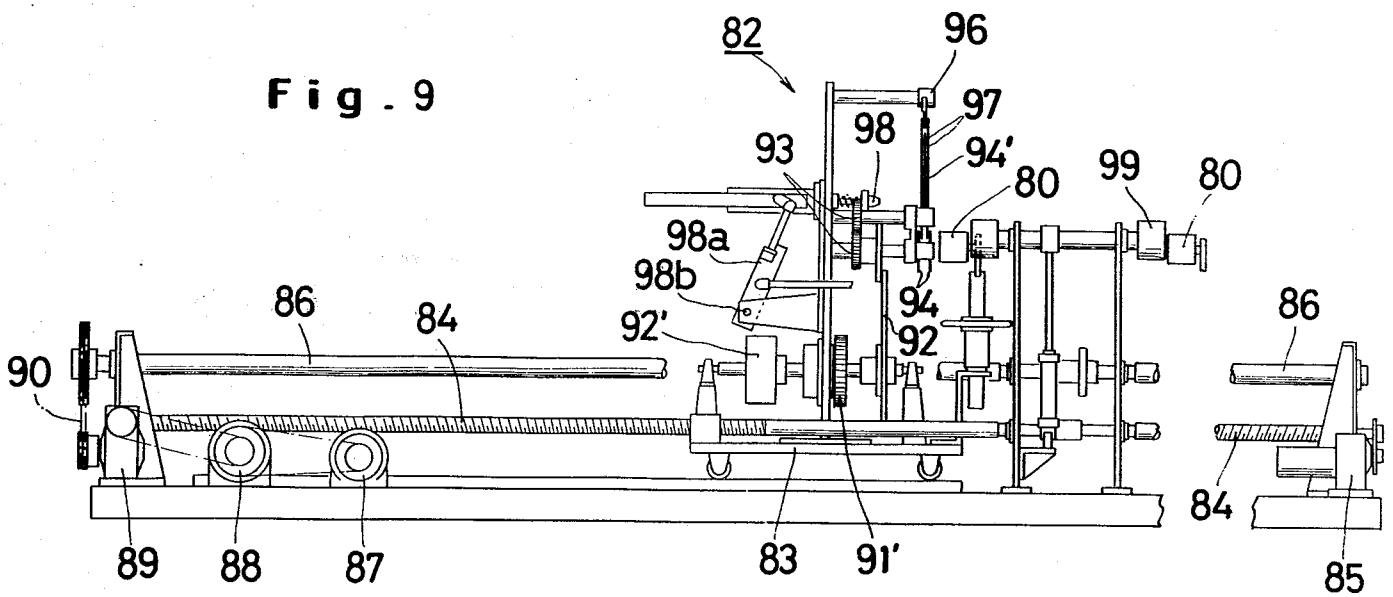
FIG. 9 is a side view of the excess portion treating device in FIG. 8.

The excess portion treating mechanism 82 is mounted on a pair of movable tables 83 are disposed symmetrically on a base about a unit including receiving rollers 80 which is fixed on the same base and movable symmetrically by rotation of guide screws 84 driven by a motor 85 which is driven according to the measured values of the length and the diameter (which affect the length of the excess sheet portion to be folded) of the roll R. A shaft 86 is for transmitting driving power to the excess portion treating mechanism 82 on the tables 83 and is driven by a motor 87 through a clutch-brake 88, variable reduction mechanism 89 and a chain 90. A shiftable gear 91 driven by a slide key of the shaft 86 operates a rod-like cam 92 through a gear 91' and an eccentric cam both mounted on the movable table 83. The cam 92 drives a pair of gears 93 meshed therewith to cause wringing arms 94 and 94' secured to the gears 93 to open and close. A small roll 95 is rotatably secured to the lower arm 94. When the roll 95 is closed, it serves to push a wringing arm 97 in contact with a third shaft 96 to cause the arm 97 to wring the excess portions. That is, the excess sheet portion is caught by the three wringing arms 94, 94' and 97 simultaneously in the three inward directions. Since the packaging paper sheet itself rotates with the roll R, the wringing actions of the three arms is performed uniformly around the periphery of the excess portion. After the wringing due to the three arms is sufficiently performed, a pushing-in plunger 98 pushes the gathered end of the excess portion into the center hollow portion of the roll R. The plunger 98 is driven by a swing rod 98*a* which swings about a fulcrum 98*b* thereof according to a variation of peripheral height of a cup shape rotating cam 92' (FIG. 9) which is coaxial with the cam 92 to swing the rear end of the plunger 98. By suitably selecting the contour of the cam 92', it is possible to advance the conical top end or apex of the plunger to an extent that the top enters shortly into the hollow of the roll R prior to the wringing to regulate the position thereof, to retire the top to wait for the wringing of the excess portion and then push the wringed excess portion into the hollow. Thus the packaging operation is completed. Since at this time, the labelling has been completed, a carry-out arm 99 is immediately actuated to take up the packaged roll and to transport it to the sending inclined table. The above explanation is for the excess portion protruding from one end of the roll. It should be understood that, for the other end, the same operation is performed.

Figure 10:
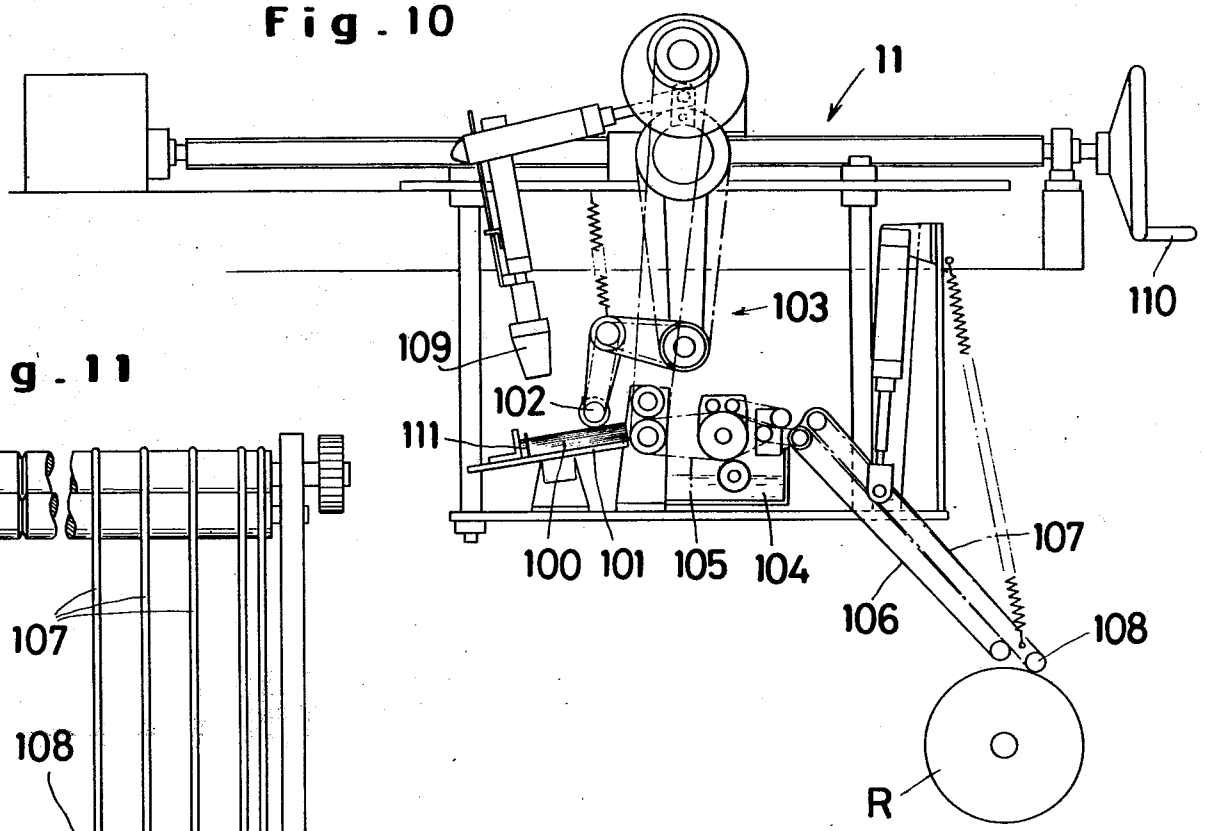
FIG. 10 is a front view of an embodiment of a labelling device according to the present invention.
Figure 11:
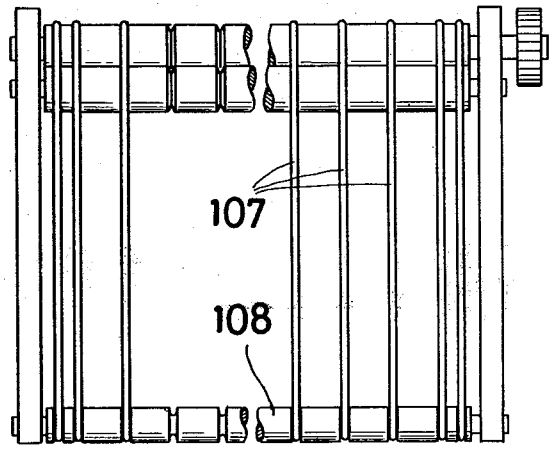
FIG. 11 is an enlarged plane view of a label passage portion of the labelling device in FIG. 10.

A label is attached to the packaged roll R. The labelling device 11 for achieving this is mounted on an extension of the upper frame 9 at an upper oblique position with respect to the excess portion treating rollers 80. FIG. 10 shows the details of this device. The main portions thereof are a label storage portion 101 for storing the labels 100 in a stack, a driving mechanism 103 having, at a top portion, a rubber roller 102 adapted to be lowered with the reduction of the labels and rotated only when the take-up of the labels is performed for feeding the labels 100 one by one, a pasting mechanism having a rubber belt 105 and functioning both to transport and to paste the labels by taking up labels 100 on the rubber belt 105 pasted by a paste container 104, a label passage provided between endless rubber belts 106 and 107 driven symmetrically to pinch the labels and carry them in one direction and a labelling roller 108 provided at the exit of the passage to perform a labelling operation. 109 is a dating stamp and it may be omitted, if necessary. 110 is a handle for regulating the position of this device. In order to urge the labelling roller 108 against the roll R, an air cylinder and a spring are used as shown.

Since it is relatively difficult to take up the labels 100 one by one from the storage portion 101, the labels 100 are provided at one edge thereof with a small hole into which a pin 111 is inserted. With this arrangement, only the uppermost label is taken up at one time with the edge portion having the small hole being broken by the pin 111. The pasting belt 105 as well as the endless belts 106 and 107 forming the label passage are formed by thin synthetic rubber strings. The belts 106 and 107 are disposed in parallel as shown in FIG. 10 such that the adjacent sides of them form the passage are slightly interrelated to assure the holding of the labels and the carrying of the labels along the passage.

With this arrangement, since the labels one surface of which are pasted are pinched by the belts 106 and 107 and carried by them without deviation and bending, the pasted portions of the labels are not disordered and can be transported to the desired position exactly. Further, since one of the belts 107 reaches the roll surface and the pasted surface of the label contacts with only the other belts 106 when the label is shifted onto the packaged roll surface, the pulley 108 of the belt 107 which is not pasted urges the label from the unpasted surface thereof to the roll surface. Therefore, there is no need of any additional pushing roller. Since, as said, the belt 106 is pasted and does not contact with other parts and the belt 106 is composed of a plurality of thin parallel rubber strings, the effect of the paste on the label surface is maintained until it reaches the roll surface, while the transfer of the label from the strings at the end of the belt to the roll surface is relatively easy.

Further, since the label passage is formed between the slightly interrelated rubber strings, there is no problem of escape of the labels from the passage which would occur when the labels are supported by only the lower side belt and the running labels can be observed through the spaces between the strings. As to the cost which is most important in actual use, the present apparatus is extremely inexpensive. This apparatus is reliable and there is no need of any expensive electrical control apparatus, releasing the operators from the relatively simple labelling procedures.

I claim:

1. A roll packaging apparatus comprising in combination, a substantially rectangular packaging table having means for effecting a packaging operation; a roll supplying device provided on one side of said packaging table; a packaging paper cutting and supplying device provided adjacent said packaging table; a transportation mechanism for positioning a cut packaging paper sheet from the supplying device in a desired position on said packaging table; a roll driving device for rollingly advancing a roll to be packaged on the paper sheet disposed on said packaging table from location of said table to another while rolling the paper sheet around the periphery of the roll to be packaged; said roll driving device comprises a vertically movable horizontal frame provided above said packaging table; endless belts provided below said horizontal frame to run along the advancing direction of the roll to be packaged and a driving means disposed to operate the endless belts; and receiving means provided adjacent an exit surface of said packaging table for receiving a roll having a paper sheet wrapped thereabout.

2. A roll packaging apparatus of claim 1 wherein said roll supplying device comprises a roller receiving means disposed immediately below said surface of said packaging table on said one side of the packaging table for receiving a roll to be packaged, and wherein said horizontal frame has disposed thereon a plurality of belt supporting arms with pivotal means to grasp a roll due to action of the belt within the supporting arms against a rotating roll.

3. A roll packaging apparatus of claim 1 wherein an excess paper portion treating device is provided adjacent the roll exit side of said packaging table, said excess portion treating device including a pair of receiving rollers for rotating the wrapped roll in a horizontally stationary position, three arms disposed for folding and gathering excess paper extending axially during rotation of the roll and plunger means disposed for inserting the gathered portion of axial paper into a central hollow of the roll.

4. A roll packaging apparatus as set forth in claim 1, wherein said roll supplying device comprises a load receiving frame supported horizontally and movable vertically, an included floor provided on said load receiving frame to discharge the roll disposed on said load receiving frame by gravity and capable of shifting the roll in the axial direction thereof and a means provided in the roll discharging side of said load receiving frame to prevent the roll from rolling out until said floor reaches an upper discharging position.

5. A roll packaging apparatus as set forth in claim 4, wherein a roll supporting portion of said load receiving frame includes rotatable rolls.

6. A roll packaging apparatus as set forth in claim 1, wherein said transportation mechanism comprises a plurality of conveyer belts moving along spaces between plate segments constituting the packaging surface plate of said packaging table from the rear end thereof to the front end thereof.

7. A roll packaging apparatus as set forth in claim 6, further comprising pressing means disposed over said conveyor belts for pressing said paper sheet during passage to said packaging table, and a mechanism for rotatably supporting said pressing means.

8. A roll packaging apparatus as set forth in claim 1, further comprising a roll direction correcting means including a triangular groove provided in the front side of said packaging table for receiving the supplied roll and a means for pushing up the received roll on said packaging table.

9. A roll packaging apparatus as set forth in claim 1, wherein said vertical driving mechanism of said vertically movable horizontal frame automatically controls the level of said vertically movable horizontal frame in response to the measured value of the diameter of the roll.

10. A roll packaging apparatus as set forth in claim 1, further comprising an excess portion treating device provided in the rear side of said packaging table, said excess portion treating device including a pair of receiving rollers for rotating the wrapped roll in a stationary position, opposing rods for folding and gathering the excess portion during the rotation of the roll and insertion rods for inserting the folded and gathered portion into a central hollow of the roll.

11. A roll packaging apparatus as set forth in claim 10, further comprising a regulation mechanism for regulating spaces between said opposing rods and said insertion rods, said regulation mechanism automatically controlling them in response to the measured values of the length and the diameter of the roll to be packaged.

12. A roll packaging apparatus as set forth in claim 10, wherein said pair of said receiving rollers comprises a level regulating mechanism, said level regulating mechanism automatically controlling said receiving rollers in response to the measured value of the diameter of the roll to be packaged.

13. A roll packaging apparatus as set forth in claim 10, further comprising an electric control box for feeding command signals obtained from the roll size to said respective regualtion mechanisms.

* * * * *